United States Patent [19]

Roen

[11] Patent Number: 4,487,318

[45] Date of Patent: Dec. 11, 1984

[54] BAG DISPENSING PACKAGE

[75] Inventor: Ralph M. Roen, Longview, Tex.

[73] Assignee: T. C. Manufacturing Co., Kilgore, Tex.

[21] Appl. No.: 329,825

[22] Filed: Dec. 7, 1981

[51] Int. Cl.[3] ..... B65D 85/62; B65D 33/36

[52] U.S. Cl. ..... 206/554; 221/63; 206/494; 206/526

[58] Field of Search ..... 206/554, 494, 526, 233; 229/62; 221/63; 150/3

[56] References Cited

U.S. PATENT DOCUMENTS

| | | | |
|---|---|---|---|
| 3,119,516 | 1/1964 | Donovan | 206/494 |
| 3,144,960 | 8/1964 | Membrino | 206/554 |
| 3,212,698 | 10/1965 | Balcom | 229/62 |
| 3,306,492 | 2/1967 | Kugler | 206/554 |
| 3,720,367 | 3/1973 | Rayner et al. | 229/62 |
| 4,274,539 | 6/1981 | Rabeneck et al. | 206/526 |

FOREIGN PATENT DOCUMENTS

| | | | |
|---|---|---|---|
| 1312782 | 4/1973 | United Kingdom | 206/554 |

*Primary Examiner*—William T. Dixson, Jr.

*Assistant Examiner*—Brenda J. Ehrhardt

*Attorney, Agent, or Firm*—McWilliams, Mann, Zummer & Sweeney

[57] ABSTRACT

A bag dispensing package includes a stack of flat bags and a surrounding flexible receptacle, conveniently in the form of a plastic bag. Each flat bag within the receptacle includes a pair of opposed walls, one of the walls having a manually graspable flap on an outwardly facing surface and the other wall including an extension that extends outwardly from the remainder of the bag. The flexible receptacle includes an access opening arranged to communicate with the manually graspable flap of the uppermost bag of the stack while the remainder of the receptacle retains the extension of the outermost bag within the receptacle. The access opening is normally closed, being defined by a pattern of perforations so that when it is desired to utilize the bags, the opening is formed by tearing the receptacle along the pattern of perforations. The uppermost bag is then removed by grasping the manually graspable flap and pulling the bag outwardly of the receptacle. Interference between the extension and the receptacle causes the bag to open upon withdrawal.

8 Claims, 11 Drawing Figures

BAG DISPENSING PACKAGE

BACKGROUND OF THE INVENTION

1. Field of the Invention

This invention relates generally to bag dispensing devices and particularly to bag packages that allow one by one withdrawal of the bags contained therein.

2. Description of the Background Art

Previously, plastic bags have been packaged for "one by one" removal within a larger plastic bag container. For example, in U.S. Pat. Nos. 3,281,056 and 3,306,492 both to Kugler, a plurality of bags are contained within a package and may be withdrawn "one by one" through an opening, which may be normally covered by a removable overlying flap. U.S. Pat. No. 3,420,433 teaches a container for plastic bags and U.S. Pat. No. 3,884,355 teaches a container for protective seat covers.

Bag dispensing devices which open the bag as it is dispensed are also known in the art. For example. U.S. Pat. No. 3,285,406 to Winesett discloses a bag dispenser with a pair of ears that cause the bag to be opened as it is torn off a binder. Similarly U.S. Pat. No. 3,782,073 to Musser discloses a similar set of ears to cause a paper bag to be opened upon removal.

SUMMARY OF THE INVENTION

It is an object of the present invention to provide a bag dispensing package wherein a plurality of stacked bags are contained within an enclosure for one handed, one by one withdrawal and automatic opening in one motion.

It is another object of the present invention to provide such a device which enables the bags to be dispensed, to remain enclosed until their time of use and to provide a package which enables the bags to be used without requiring initial unpackaging of the bags.

It is still another object of the present invention to provide a device which enables bags to be packaged and dispensed efficiently and economically.

These and many other objects and advantages of the present invention are achieved by a bag dispensing package that includes a stack of flat bags, each bag including a pair of opposed walls joined along their opposed common edges. A first of the walls includes a manually graspable flap and the second of the walls includes an extension extending outwardly of the remainder of the bag. A receptacle encloses the bags. The receptacle may be flexible or rigid and includes at least one access opening arranged to communicate with the flap of the uppermost bag of the stack. The opening defines a lip portion surrounding the opening. The extension of the uppermost bag is located beneath the lip portion.

DESCRIPTION OF THE PREFERRED EMBODIMENT

Figure 1:
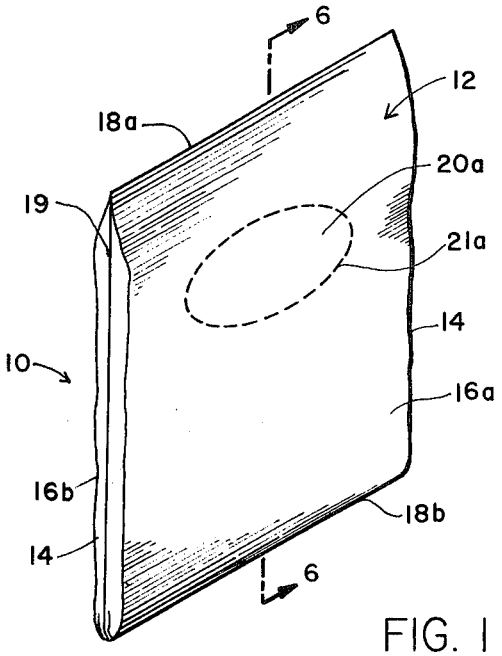
FIG. 1 is a perspective view of one embodiment of the present invention.

Referring to the drawing wherein like reference characters are used for like parts throughout the several views, there is shown in FIG. 1 a bag dispensing package 10 including a flexible receptacle 12, conveniently in the form of a plastic bag. The receptacle 12 includes a pair of opposed side edges 14, a pair of opposed front and rear walls **16*a* and 16*b*, and a pair of opposed upper and lower ends 18*a* and 18*b*. The receptacle 12 may be formed in a conventional fashion by folding the walls 16*a* and 16*b* towards one another about end 18*b* and sealing them together along spaced lateral seal lines 19 (only one of which is shown), and end 18*a* (see FIG. 6). A conveniently circular tear-out panel 20*a* is defined by a pattern of perforations 21*a* on the front wall 16*a* adjacent the upper end 18*a***.

Figure 2:
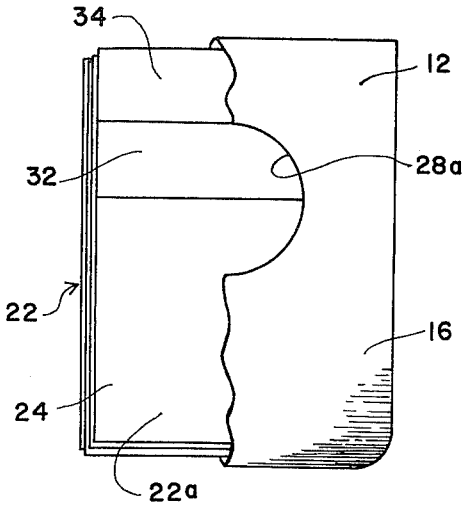
FIG. 2 is a partially cut-away front elevational view of the embodiment shown in FIG. 1.

A plurality of flat flexible bags 22 are contained within the interior of the receptacle 12, as shown in FIG. 2. The bags 22 are conveniently arranged in a stack with the opposed front and rear walls **24*a* and 24*b* of each bag parallel to the opposed walls 16*a* and 16*b* of the receptacle 12. Like the receptacle 12, each bag 22** is conveniently made of plastic by conventional bag forming techniques.

Figure 3:
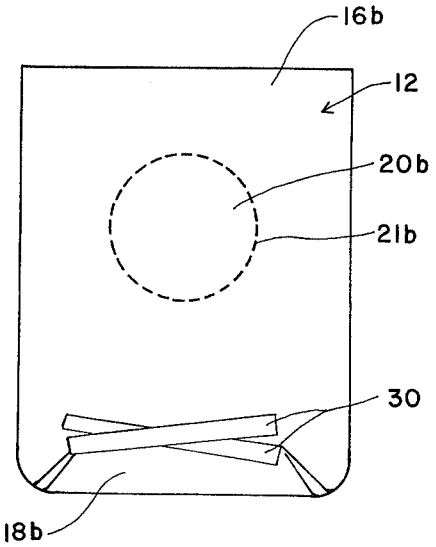
FIG. 3 is a rear plan view of the embodiment of the present invention shown in FIG. 1.
Figure 6:
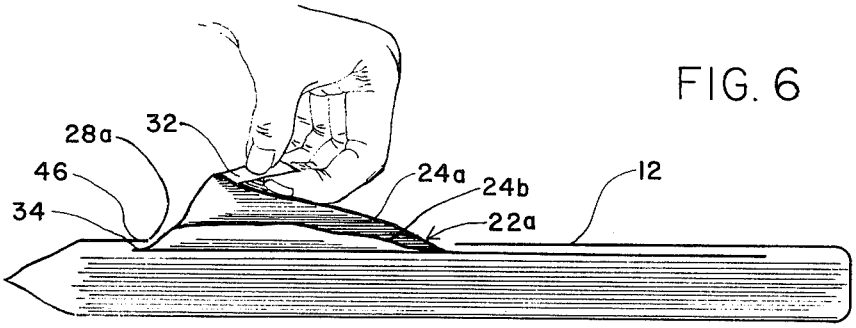
FIG. 6 is an enlarged cross-sectional view taken generally along the line 6—6 in FIG. 1 with the front access panel removed and showing a bag in the process of being manually removed.

As shown in FIG. 3, the rear wall **16*b* of the receptacle 12 may also include a tear-out panel 20*b* aligned with the tear-out panel 20*a* on the opposite wall 16*a*. The tear-out panel 20*b* is also defined by a conveniently circular pattern of perforations 21*b*. When either tear-out panel 20 is removed, a conveniently circular access opening 28*a*, shown in FIGS. 2 and 6, is defined in the receptacle 12 preferably having a diameter less than the width of the bags 22. In one preferred embodiment, the access opening 28*a* is about $\frac{1}{3}$ the width of the receptacle 12 or the individual bags 22. After the receptacle 12 has been filled with bags 22, the open end 18*b* of the receptacle 12 is conveniently folded against the rear wall 16*b* and secured thereto by an attachment means 30**, preferrably an adhesive attachment means, such as adhesive tape or the like.

Figure 4:
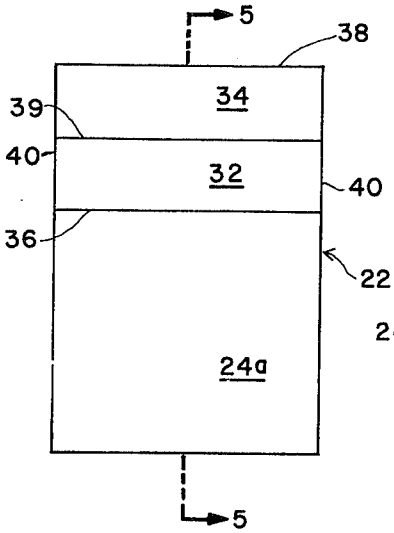
FIG. 4 is a front elevational view of the bag shown in FIG. 2.
Figure 5:
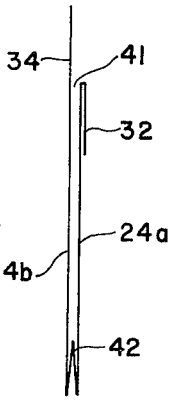
FIG. 5 is a cross-sectional view taken generally along the line 5—5 in FIG. 4.

Each bag 22 preferrably includes a manually graspable flap 32 connected to the bag wall **24*a* and an outwardly extending extension 34 connected to the bag wall 24*b*, as best shown in FIGS. 4 and 5. The size of the flap 32 preferrably coincides with the size of the extension 34 so that the bag 22 may be made by folding a sheet of plastic upon itself with the outward edge 36 of the flap 32 initially adjacent the outward edge 38 of the extension 34. The flap 32 is then folded down against the outside of the remainder of the wall 24a forming a folded edge 39, and the opposed walls 24a and 24b thereafter sealed together, such as by heat sealing along peripheral opposed common edges 40, thereby securing the flap 32 to the walls 24a and 24b. Thus the extension 34 is preferrably both coplanar and integral with the rear wall 24b and extends above the folded edge 39 of the front wall 24a. The bag opening 41 then is located between the edge 39 and the adjacent portion of the bag wall 24b. As shown in FIG. 5, the bottom of the bag 22 may conveniently include a gusset 42**.

The tear-out panel 20a is aligned to communicate with the exposed flap 32 of the uppermost bag 22a as indicated in FIG. 2, and yet shape the front wall 16a of receptacle 12 to define a lip portion 46 that overlies the extension 34 of the uppermost bag 22a. Therefore, when the panel 20a is removed, the flap 32 of the uppermost bag 22a is manually graspable by reaching through the access opening 28a that is disposed to expose flap 32 and have the upper portion of the margin of access opening 28a approximating tangency relation with the underlying bag edge 39 (see FIG. 2), so that the extension 34 of the uppermost bag remains under the lip portion 46 across the upper end of the receptacle 12. Since the bags 22 are all preferably arranged with their flaps 32 facing the access opening 28a, the flap 32 of each succeeding bag 22 is also capable of communicating with the opening 28a.

The package 10 is utilized as follows. The user initially removes the tear-out panel 20a by grasping the panel 20a and pulling outwardly. The panel 20a tears along the line of perforations 21a revealing the underlying manually graspable flap 32 of the uppermost bag 22a. The user then reaches through the access opening 28a defined by the pattern of perforations 21 and grasps the flap 32 between the thumb and forefinger as shown in FIG. 6. As the user pulls the flap 32 outwardly away from the receptacle 12 the bag walls 24 are separated due to the interference between the extension 34 on the wall 24b and the lip portion 46 of the receptacle 12 that surrounds the opening 28a that effects a draging action on the bag extension 34. As the user continues to pull outwardly on the flap 32 the extension 34 eventually clears the lip portion 46 and the bag 22 may be pulled free of the receptacle 12. However, the bag 22 has been opened in the process and the separation between the walls 24a and 24b thereof is maintained after complete withdrawal of the bag due to the wrinkling of the walls 24a and 24b during their passage through the confining access opening 28a. After the removal of the uppermost bag 22 the next underlying bag is exposed for similar withdrawal.

Thus, the bags 22 may be withdrawn "one-by-one" and opened in the same motion using only one hand, with the flap 32 serving as a handle for the individual bags 22 for both withdrawing and opening them in the manner indicated. The user can then use his or her other hand to grasp the object to be placed in the bag 22. If desired, bags 22 may be withdrawn from the bottom of the receptacle 12 as well, by removing the tear-out panel 20b from the wall 16b. However, the bags 22 removed in this manner are not automatically opened during withdrawal and must be subsequently opened by the user.

Figure 7:
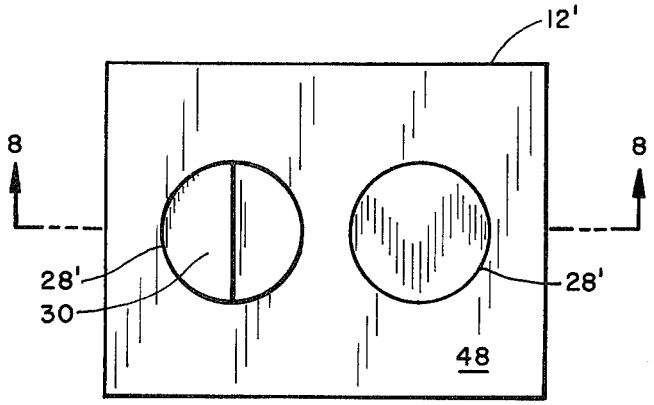
FIG. 7 is a top plan view of another embodiment of the present invention.
Figure 8:
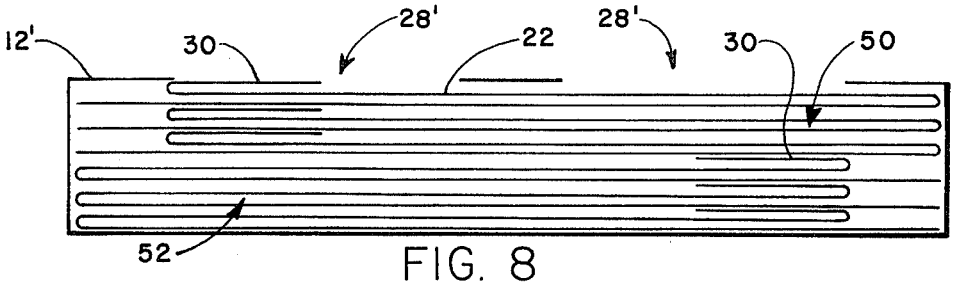
FIG. 8 is an enlarged schematic cross-sectional view taken generally along the line 8—8 in FIG. 7 with the bags shown somewhat laterally expanded for illustration purposes.

In accordance with another aspect of the preferred embodiment, a pair of access openings 28' can be provided on the same wall 48 of a receptacle 12', as shown in FIG. 7. If desired these openings 28' may be covered with removable tear-out panels until ready for use, as described previously. As shown in FIG. 8, the bags 22 are arranged within the receptacle 12' in a pair of stacks 50 and 52, each stack being composed of aligned parallel bags 22 rotated 180° with respect to the bags 22 making up the other stack 50 or 52. The bags 22 of each stack 50, 52 have their flaps 30 aligned with a different one of the pair of openings 28'.

Thus, the bags 22 may be initially withdrawn from the stack 50 through the aligned opening 28' and thereafter, when the stack 50 is exhausted, the bags 22 may be withdrawn from the stack 52 through the other opening 28'. The combined stacks 50 and 52 are more level because of the off-setting of the flaps 30, which would otherwise produce a "lump" near one end of the receptacle 12'. This facilitates packaging, transportation, and handling of the receptacles 12'.

Figure 9:
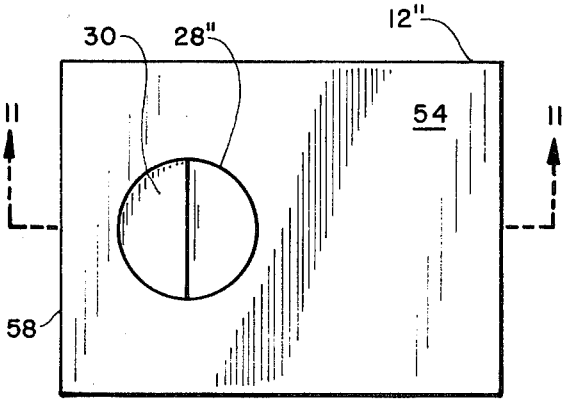
FIG. 9 is a top plan view of another embodiment of the present invention.
Figure 10:
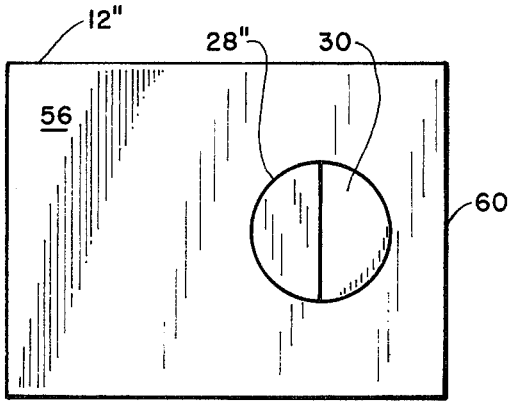
FIG. 10 is a bottom plan view of the embodiment shown in FIG. 9.
Figure 11:
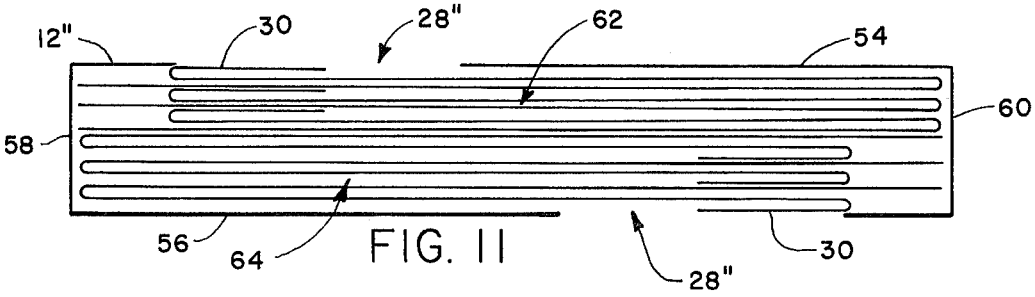
FIG. 11 is an enlarged schematic cross-sectional view taken generally along the line 11—11 in FIG. 9 with the bags shown somewhat laterally expanded for illustration purposes.

In accordance with another aspect of the preferred embodiment, a receptacle 12'' has a pair of access openings 28'', one on each wall 54, 56 of the receptacle 12'' near a different end 58, 60 of the receptacle as shown in FIGS. 9 and 10. If desired, the openings 28'' may be covered with removable tear-out panels until ready for use, as described previously. As shown in FIG. 11, the bags 22 are arranged within the receptacle 12'' in a pair of stacks 62 and 64. The bags 22 forming the stack 62 face the opening 28'' in the wall 54 of the receptacle 12'' while the bags 22 forming the stack 64 face the opening 28'' in the wall 56 of the receptacle 12''.

Thus, the bags 22 may be withdrawn from either opening 28''. Again since the flaps 30 of one stack 62, 64 are offset from the flaps 30 of the other stack, the receptacle 12'' has a more uniform, level thickness and is less prone to the formation of lumps which make the receptacles more difficult to handle.

Time and motion studies were performed comparing the use of the bag dispensing package of the present invention to standard plastic "wet" bags used today in grocery check-out counters. The standard "wet" bags are packed 500 in a box with an opening in one end of the box for removing the bags. Once a bag is removed from the box of standard "wet" bags, the grocery packer must first find the opening, open the bag with one hand, place her hand in the bag to open it, and then pick up the item and place it in the bag. Using the bag dispensing package of the present invention, a bag is removed with one hand while the other hand inserts the item in the bag. The time and motion studies showed a savings of four seconds per bag when using the bag dispensing package of the present invention.

The foregoing detailed description has been given for clearness of understanding only and no unnecessary limitations should be understood therefrom since many modifications are suggested by the above disclosure and the description therewith and additional modifications would be obvious to those skilled in the art.

What is claimed is:

1. In a bag dispensing package that includes a stack of flexible bags of like quadrilateral marginal configuration that are of substantially the same size and that are in substantially superposed coincident relation throughout the stack, with each bag including a closed lower end and and open upper end and comprising a front wall and a back wall for the bag that are joined along the sides and lower end of the bag to define the bag pocket and that are free of connection along the upper bag end to provide the opening to the bag pocket there between, and with the back wall of each bag having an extension at the bag upper end that projects upwardly of the bag and beyond the bag opening, and the front wall of each bag at the open end of the bag defining a downwards directed flap that is exterior of the bag and defines an edging that is directed toward the bag lower end and away from the bag opening, and with said extensions of the respective bags being of substantially the same size and said flaps of the respective bags being of substantially the same size, wherein the stack includes at least one group of said superposed bags that have their extensions and flaps in substantially congruent relation, and a closed receptacle in which the stack of bags is received and including front and back walls that are in substantially coextensive relation and that substantially complement the marginal configuration of the stack bags, with the receptacle enclosing the stack and said bag group being adjacent the receptacle front wall with the front walls of the bags thereof facing the receptacle front wall, and the receptacle defining upper and lower ends corresponding to the positions of the upper and lower ends of the bags of said bag group, the improvement for permitting consecutive bags of the stack group to be simultaneously withdrawn from the receptacle and opened as they are so withdrawn, said improvement comprising:

said front wall of said receptacle being formed to define an access opening that is positioned relative to said stack group to expose the flap, including its said edging, of the consecutive uppermost bags of the stack group, said front wall of said receptacle adjacent the upper end of the receptacle overlying the back wall extensions of the bags of said bag group continuously across the upper end of the receptacle down to approximately the position of the openings of the respective bags of said group for shaping said receptacle front wall to define a receptacle front wall lip portion behind which the back wall extensions of the bags of said bag group lie, wherein the bags of the stack group may be consecutively withdrawn from the receptacle and simultaneously with each withdrawal opened by the user using one hand, with regard to the uppermost bag of the stack group, to reach under the exposed edging of the flap thereof, grip the flap between the hand thumb and forefinger, and pull such uppermost bag outwardly of the receptacle through the access opening, with the drag of the said extension of such uppermost bag against said lip portion and the pulling action on the flap thereof outwardly of the access opening, effecting opening of the bag.

2. The improvement set forth in claim 1 wherein:

said access opening is dimensioned laterally of the receptacle to be of less width than the bags of said stack group.

3. The improvement set forth in claim 2 wherein:

said access opening is substantially centered on said stack adjacent the upper end of said receptacle.

4. The improvement set forth in claim 1 wherein:

all the bags within the receptacle comprise said stack group.

5. The improvement set forth in claim 1 wherein:

the bag stack includes a second group of said bags, with the bags of said second group being oriented to dispose their upper and lower ends oppositely of those of the bags of the first mentioned group, with the front walls of said bags of said second group facing one of the receptacle said walls, said receptacle one wall being formed to define a second access opening that is positioned relative to said second stack group to expose the flap, including its said edging, of the consecutive bags facing said receptacle one wall, said receptacle one wall adjacent the lower end of the receptacle overlying the back wall extensions of the bags of said bag second group continuously across the lower end of the receptacle up to approximately the openings of the respective bags of said second group, said second access opening being located in said receptacle one wall relative to the receptacle lower end for shaping said receptacle one wall to define a second wall lip portion behind which the back wall extensions of the bags of said second bag group lie, whereby the bags of said second stack group may be consecutively withdrawn from the receptacle through said second access opening and simultaneously with such withdrawal thereof opened in the same manner as the bags of the first mentioned stack group are withdrawn and opened through said first access opening.

6. The improvement set forth in claim 1 wherin:

said access opening is substantially circular in configuration and is in substantially tangent location relation relative to the bag openings of the bags of said bag group.

7. The improvement set forth in claim 6 wherein:

said receptacle includes means for removably covering said access opening.

8. The improvement set forth in claim 1 wherein:

said extension and said flap of the respective bags of said group are of substantially equal dimensions longitudinally of the respective bags.

* * * * *